United States Patent [19]

Kotkata et al.

[11] Patent Number: 4,863,006

[45] Date of Patent: Sep. 5, 1989

[54] AUTOMATIC SHUTOFF APPARATUS FOR AN ESCALATOR

[75] Inventors: Nabil Kotkata; Mark D. Blondiau; Gerhart Rulke, all of Vienna, Austria

[73] Assignee: Inventio AG, Switzerland

[21] Appl. No.: 238,906

[22] Filed: Aug. 31, 1988

[30] Foreign Application Priority Data

Sep. 1, 1987 [CH] Switzerland ..... 03350/87

[51] Int. Cl.[4] ..... B66B 25/00

[52] U.S. Cl. ..... 198/323; 198/333; 198/502.4; 198/856

[58] Field of Search ..... 198/322, 323, 333, 327, 198/502.4, 855, 856

[56] References Cited

U.S. PATENT DOCUMENTS

| | | | |
|---|---|---|---|
| 4,151,381 | 4/1979 | Holuba | 200/61.39 |
| 4,282,967 | 8/1981 | Boling et al. | 198/856 X |
| 4,366,897 | 1/1983 | Azuma et al. | 198/502.4 |
| 4,629,052 | 12/1986 | Kitamura | 198/323 |
| 4,664,247 | 5/1987 | Wolf et al. | 198/856 X |

FOREIGN PATENT DOCUMENTS

| | | | |
|---|---|---|---|
| 0082074 | 4/1986 | European Pat. Off. . | |
| 628503 | 3/1936 | Fed. Rep. of Germany . | |
| 0137691 | 9/1979 | Fed. Rep. of Germany | 198/502.4 |
| 3319831 | 12/1984 | Fed. Rep. of Germany . | |
| 2829474 | 10/1986 | Fed. Rep. of Germany . | |
| 2941119 | 8/1987 | Fed. Rep. of Germany . | |

*Primary Examiner*—Robert J. Spar
*Assistant Examiner*—D. Glenn Dayoan
*Attorney, Agent, or Firm*—Marshall & Melhorn

[57] ABSTRACT

A pair of light barriers are mounted on a pair of spaced apart balustrade sockets located on opposite sides of an endless step conveyor-type escalator. The light barriers are positioned at the transition of upper and lower transisition arches to an inclined run of the conveyor. The light barriers each include a transmitter and receiver for emitting and receiving a light beam transversely to the direction of travel of the conveyor. The light beam is interrupted by side shields on the conveyor steps. An opening is formed adjacent a leading edge of each side shield and one or more openings are formed adjacent a trailing edge of each side shield. The trailing edge openings are formed as oblong holes each with a longitudinal axis extending with respect to the tread of the step at the same angle as the inclination of the inclined run of the escalator with respect to the horizontal. The oblong holes are formed at different angles corresponding to typical angles and inclination such that the side shields can be used with different standard escalator installations.

13 Claims, 3 Drawing Sheets

AUTOMATIC SHUTOFF APPARATUS FOR AN ESCALATOR

BACKGROUND OF THE INVENTION

The invention relates generally to escalators and, in particular, to an apparatus for the initiation of the shut down of an endless step conveyor belt.

Typically, endless step conveyor belt type escalators consist of a plurality of steps attached between two endlessly circulating flat link chains and guided between two balustrade skirtings. The steps form a lead, which can be stepped down, and a return. The lead has upper and lower horizontal runs, an inclined run and two transition arches which connect opposite ends of the inclined run with the horizontal runs.

For reasons for safety, every escalator has a number of monitoring and shutoff devices, many of which are required to comply with the local safety regulations. For example, the return movement of an upwardly moving escalator has to be prevented, or a downwardly moving escalator must not exceed the normal velocity by more than 20% and has to be stopped automatically on reaching excess velocity. Likewise, an escalator has to be switched off if a step lowers such that the tread of the step cannot, for some reason, be guided any longer in a satisfactory manner through a fixed gate.

Such a device for the shutoff of an escalator is shown in the German Pat. No. DE 628 503. When the escalator velocity exceeds the normal velocity by about 20%, shutdown is initiated. The movement of the step conveyor belt is by a direct current motor, which drives the main shaft by way of a speed reduction drive and a chain drive. A regulator operating by the centrifugal force system is driven by a chain from the main shaft and monitors the escalator travel velocity. An electromagnet in the regulator adjusts a regulating sleeve of a velocity controller corresponding to the chosen normal travel velocity, so that the controller will only respond at two selected travel velocities and stop the escalator when a predetermined excess velocity is reached. For the selection of the velocity and direction of travel, a selector switch for a low and a high velocity and a direction switch are housed in an instrument cabinet.

Another device for the shutoff of escalators is shown in the German Patent Application No. DE 33 19 831. A shutoff apparatus switching means is operable by the lowering of a step of the escalator. The switching means includes a spring-suspended supported copper wire insulated with respect to the supporting structure of the conveying installation. One pole of a direct current source is connected to the copper wire, and the other pole is connected to the supporting structure of the conveying installation. As soon as a tread body is lowered, for example, when the rubber tire of a running roller of a tread body loaded by at least one passenger drops off, the step body contacts the copper wire and closes the circuit of the direct current source. The drive of the conveying belt is then switched off by a relay.

A further device for the shutoff of an escalator is shown in the European Pat. No. 082 074, in which, with the aid of at least a distance sensor positioned in the return of the step conveyor, every single step is monitored by a logic circuit. At the absence of a step, the logic circuit generates an error signal on command of the distance sensor and causes the immediate stop of the escalator by way of a relay.

Another device for the shutoff of an escalator is shown in the U.S. Pat. No. 4,151,381. The escalator is stopped automatically as soon as the step conveyor moving for upward travel starts to move unintentionally to a downward direction. An idler roll driven by the main drive shaft of the drive has a peripheral groove which is in frictional connection with an operating rod. The rod rests in the peripheral groove and is axially slidingly supported, and interacts with a switching lever of a limit switch. With an upward moving step conveyor, the idler roll is driven counterclockwise, where the operating rod is pulled away by friction from the switching lever of the limit switch and abuts a detent plate. If the step conveyor reverses, the operating rod is pushed by the friction of the clockwise moving idler roll against the switching lever of the limit switch, whereby the limit switch is operated and the escalator is stopped.

All the above described devices for the shutoff of an escalator have the drawback that a separate apparatus is required for each individual monitoring task, and that each monitoring apparatus is relatively expensive.

SUMMARY OF THE INVENTION

The present invention therefore is an apparatus for the shutoff of escalators, by means of which several independent safety devices can be monitored and the escalator is stopped in response of one of the monitored safety devices. The advantages of the invention are provided by light barriers built into the balustrade at the upper and lower ends of the inclined run and connected to an electronic evaluating circuit. As the steps pass the light barriers, a periodic bright-dark pattern is generated which is compared by the evaluating circuit with a stored pattern for normal operation. If a change occurs in the monitored pattern, caused for example by a lowered step or excess velocity, the escalator is immediately automatically stopped.

The present invention generates the bright-dark pattern by providing a plurality of oblong holes in the side shields of each step. Each hole has a different angle of inclination such that the longitudinal axes correspond to the various predetermined inclinations of escalators. The holes are formed of different lengths and are displaced with respect to one another. The light barriers each generate a beam of light across the escalator path of travel which beam passes through the holes. The apparatus according to the present invention can be used with any escalator inclinations and length.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
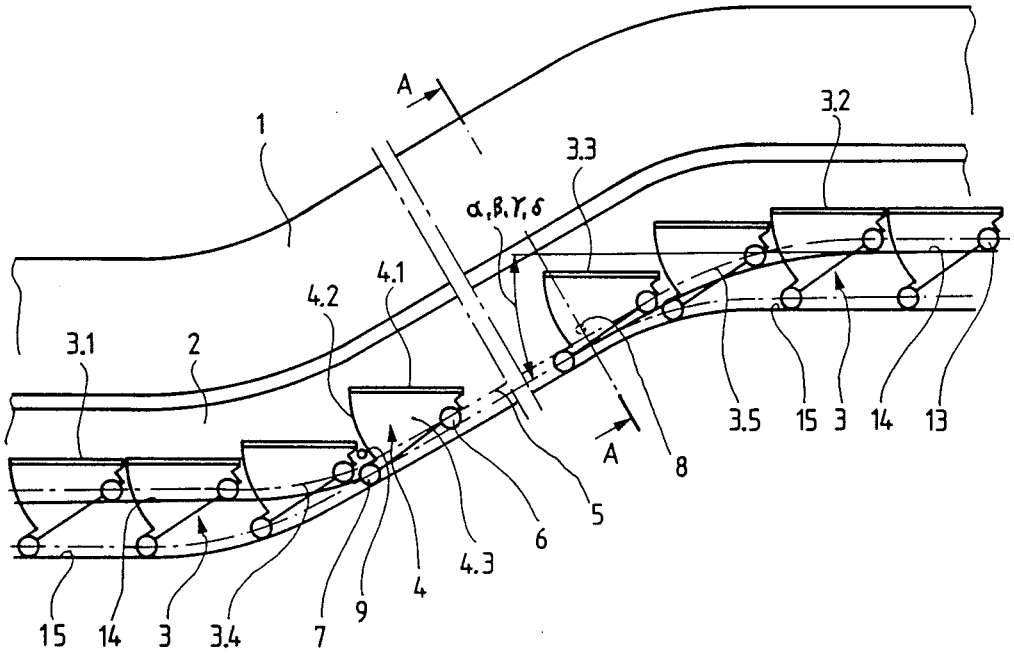
FIG. 1 is a side elevation view of an escalator incorporating the present invention.
Figure 2:
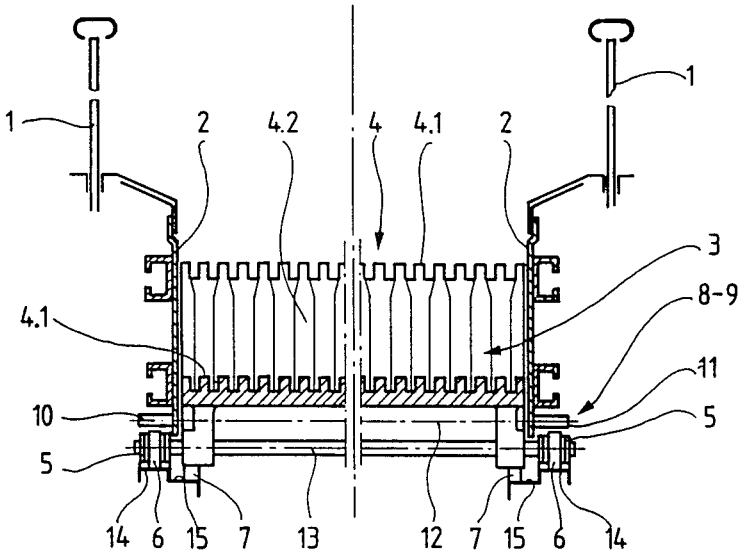
FIG. 2 is a cross-sectional view taken through the escalator along the line A—A in FIG. 1.

Designated with the number 1 in the FIGS. 1 and 2 is a balustrade of an escalator arranged on both sides of a step conveyor 3 assumed to be moving in the upward direction. The step conveyor 3 consists of a number of steps 4 which are supported between two spaced apart, endlessly circulating flat link chains 5. The leading edge of each step 4 is attached to a step shaft 13 connecting the two flat link chains 5 together, and the steps form a lead to be stepped upon and a return (not shown). The lead of the step conveyor 3 is divided into a lower horizontal run 3.1, and upper horizontal run 3.2, an inclined run 3.3 between the horizontal runs, a lower transition arch 3.4 connecting the horizontal run 3.1 with the inclined run 3.3, and an upper transition arch 3.5 connecting the horizontal run 3.2 with the inclined run 3.3.

Each step 4 has a generally horizontal tread surface 4.1, a generally vertical riser 4.2 at the trailing edge of the tread 4.1, and two vertically extending shields or abutments 4.3 at opposite sides of the tread 4.1. Two chain rollers 6 are attached to opposite ends of the step shaft 13 and two trailing rollers 7 are attached to the opposite lower edges of the riser 4.2. The chain rollers 6 engage a pair of spaced apart chain guides 14, and the trailing rolls 7 are supported on a pair of spaced apart roller guides 15. Thus, the lead of the step conveyor 3 is guided between two spaced apart balustrade sockets 2, positioned below the associated balustrades 1.

At the upper end of the inclined run 3.3 of the step conveyor 3, prior to the transition to the upper transition arch 3.5, a light barrier 8 is built into the balustrade sockets 2. The barrier 8 includes a transmitter 10 in one socket 2, and a receiver or reflector 11 in the other sockets 2 for generating a light beam 12 radiated across the direction of travel of the step conveyor 3 for travel in the upward direction. Provided likewise at the lower end of the inclined run 3.3 of the step conveyor 3, prior to the transition to the lower transition arch 3.4, is a light barrier 9 with a transmitter 10 and a receiver or reflector 11 for generating a light beam 12 between the balustrade sockets 2 for travel in the downward direction. The positions of the light barriers 8 and 9 are chosen in such a manner that the light beam 12 is directed over the flat links of the flat link chain 5 transversely to the step conveyor 3 from one balustrade socket 2 to the other and is interrupted by each step 4. The beam 12 is interrupted by the side shields 4.3 between the chain rollers 6 and the riser 4.2, while it can be received unobstructedly between the riser 4.2 of one step and the chain rollers 6 of the neighboring step 4 by the receiver or reflector 11 of the light barriers 8 and 9.

Figure 3:
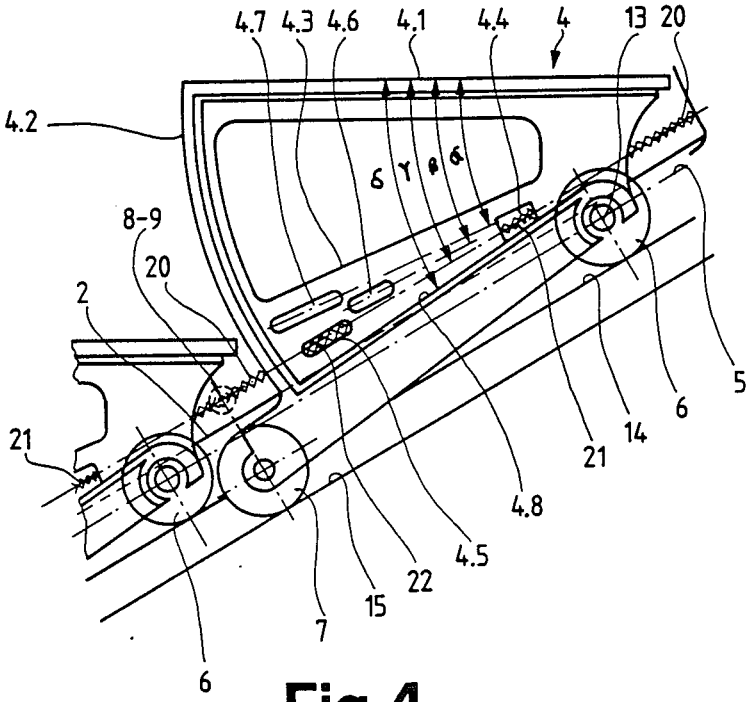
FIG. 3 is an enlarged side elevation view of one of the steps in FIG. 1.
Figure 4:
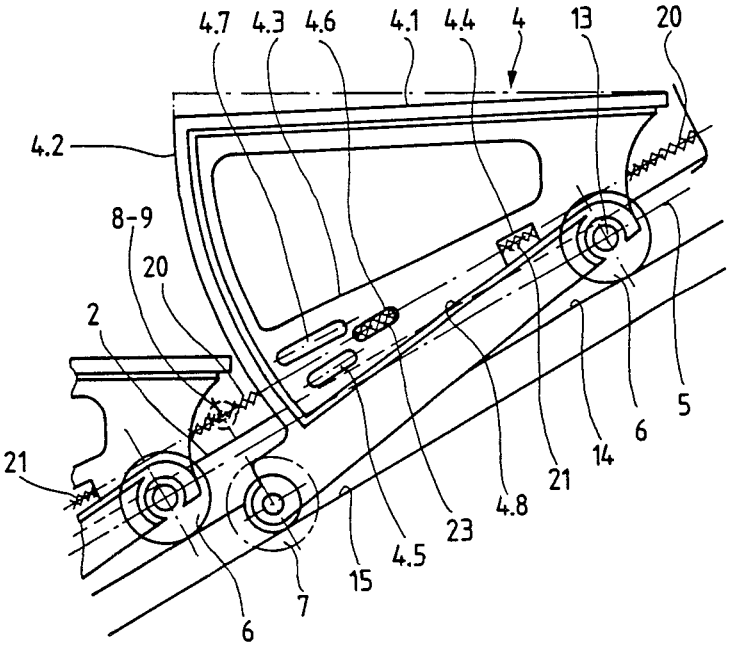
FIG. 4 shows the step of FIG. 3 lowered from the normal operating position.

In the FIGS. 3 and 4 there is shown the step 4 which is applicable for all normalized inclinations of escalators. Every step 4 is composed of the tread 4.1, the riser 4.2 and the two side shields or abutments 4.3 and is connected by a step shaft 13 with the two flat link chains 5 arranged laterally near the step 4. In each case, two chain rollers 6 and two trailing rolls 7 supported between the flat links of the flat link chain 5 carry each step 4 and are supported on the chain guide 14 and the roller guide 15 respectively.

Built into the balustrade sockets 2 and positioned laterally near the steps 4 are the light barriers 8 and 9. Different openings are provided in both side shields 4.3 of the steps 4 which correspond to different inclinations of the escalator. On passage of the steps 4 at the light barriers 8 and 9, the opening corresponding to the inclination of the escalator will let the light beam 12 pass unobstructedly from the transmitter 10 to the receiver or reflector 11. An opening or hole 4.4 adjacent a leading edge in the immediate proximity of the step shaft 13 is utilized for all types of escalators. An oblong opening or hole 4.5 adjacent a trailing edge near the riser 4.2 is used for a 30° escalator. An oblong opening or hole 4.6 adjacent the hole 4.5 is used for a 27.3° escalator. An oblong opening or hole 4.7 above the hole 4.5 is used for a 24.5° escalator. For a 35° escalator, no oblong hole is provided. The central axes of the oblong holes 4.5, 4.6, and 4.7 and of a reinforcing or strengthening rib 4.8 in the side shields 4.3 extend at the same angles of inclination with respect to the tread 4.1 of the step 4 as the corresponding angle of inclination of the inclined run 3.3 of the step conveyor 3 to the horizontal.

| | |
|---|---|
| Hole 4.7, | $\alpha = 24.5°$ inclination |
| Hole 4.6, | $\beta = 27.3°$ inclination |
| Hole 4.5, | $\nu = 30°$ inclination |
| Rib 4.8, | $\delta = 35°$ inclination |

In this way the central axes of the oblong holes 4.5, 4.6, and 4.7 and the rib 4.8 representing the inclined run 3.3 of the step conveyor 3, always run parallel to the respective chain guides 14 or the roller guides 15 and coincide in normal operation with the central axis of the light beam 12 of the light barriers 8 and 9. With the exception of the 35° escalator, particular oblong holes are provided for each possible escalator inclination, which holes are arranged displaced or staggered with respect to each other and are of different lengths. Thus, a lowered step in any escalator inclination will produce a correct hole pattern.

Figure 5:
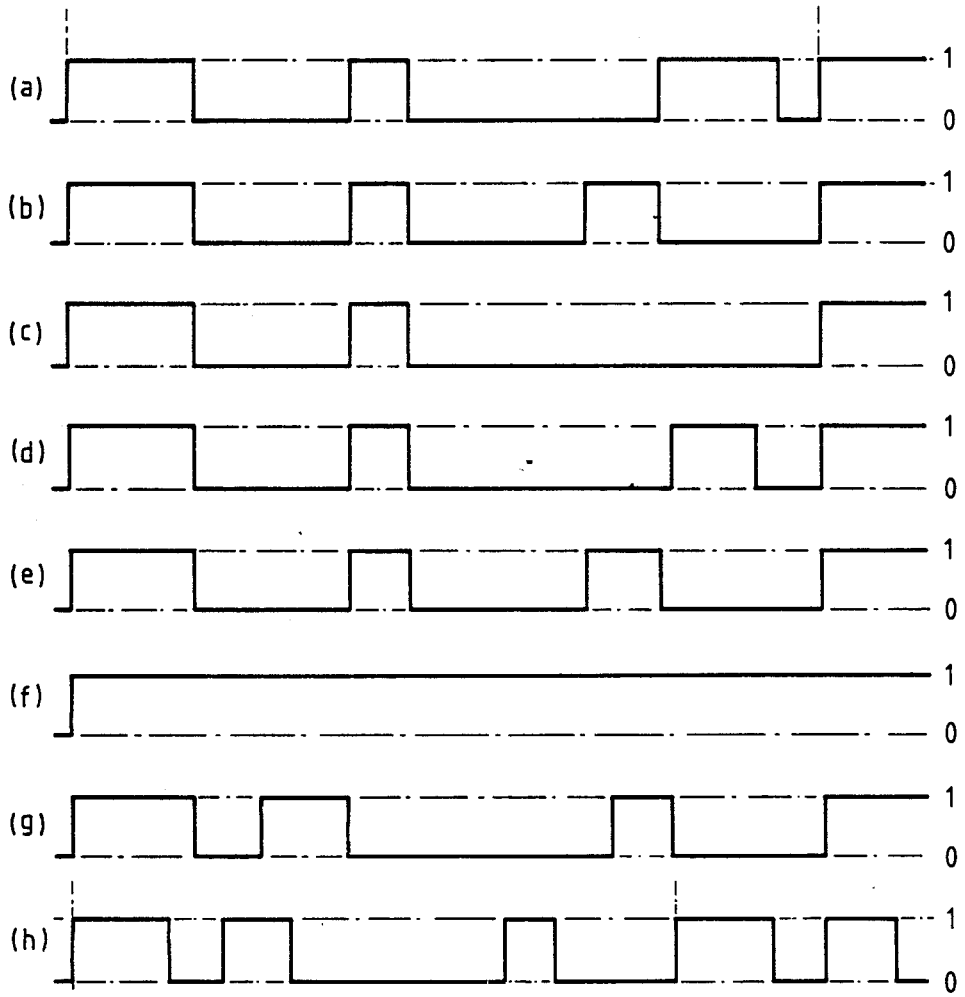
FIG. 5 is an amplitude versus time diagram of the light-dark intervals generated by the present invention for various types of escalators in normal operation and in the types of operation requiring shutdown of the escalator.

Indicated in each case by a double crosshatched length of path 20, 21, and 22 in FIG. 3, for a 30° escalator in normal operation, are the light pulses generated on the passage of the step conveyor 3 through the light beam 12 of the light barriers 8 and 9. The light pulses generated on the passage of a lowered step 4 are likewise indicated by doubly crosshatched lengths of path 20, 21, and 23 in the FIG. 4. The FIGS. 5(*a*), 5(*b*), 5(*c*), and 5(*d*) show sequentially in each case the bright-dark intervals of an escalator with 24.5°, with 27.3°, with 35° and with 30° inclination respectively each in normal upward operation. The amplitude "1" represents passage of the beam 12 and the amplitude "0" represents blockage of the beam. In each of the amplitude versus time diagrams, the path 20 between the steps generates the first pulse to the left, and the path 21 through the hole 4.4 generates the next pulse. In FIG. 5(*a*), the path 22 through the hole 4.7 generates the third pulse. In FIG. 5(*b*), the path 22 through the hole 4.6 generates a shorter third pulse earlier. In FIG. 5(*c*), the path 22 is blocked by the rib 4.8 and no third pulse is generated. In FIG. 5(*d*), the path 22 through the hole 4.5 generates the third pulse. In each case, the length and timing of the third pulses are determined by the length and position respectively of the corresponding holes.

The FIGS. 5(*e*), 5(*f*), 5(*g*), and 5(*h*) for a 30° escalator each show the bright-dark intervals during defective operation. For instance, in FIG. 5(*e*) a lowered step shifts the path 22 from the hole 4.5 to the hole 4.6 to generate the third pulse. In FIG. 5(*f*), a missing step permits passage of the beam continuously. In FIG. 5(*g*), an unintentional reverse run reverses the order of the second and third pulses. In FIG. 5(*h*), at about 20% excess velocity in a downward direction of operation, the pulses are reduced in width and increased in frequency. The bright-dark intervals according to FIG. 5(*g*) also apply to a downward running escalator in normal operation.

The apparatus according to the present invention operates in the following method. The light barriers 8 and 9 built into the balustrade sockets 2 in the inclined run 3.3 of the step conveyor 3 ahead of the upper transition arch 3.5 and the lower transition arch 3.4 respectively generate the pulses shown in FIG. 5. If the element 11 is a receiver, it will generate the pulses. If the element 11 is a reflector, the transmitter 10 generates the pulses. The receiver or another conventional element typically converts the light pulses into electrical pulses which are monitored by an electronic evaluation circuit including a memory and a signal comparator which can be commercially available circuits. Each of the patterns shown in FIG. 5 can be stored and generated to the comparator to operate a control for the escalator brake. On passage of the step conveyor 3 at the upper light barrier 8 for the upward direction of movement, the periodically received bright-dark intervals are compared with a bright-dark sample stored for the corresponding normal operation and evaluated. If any change of the intervals or of the sample occurs, for example at a lower velocity, by a lowered step, by a missing step or on reversal of a direction of travel, the escalator is immediately switched off and stopped by the brake. The distance of the light barrier from the beginning of the associated horizontal run is chosen such that it is greater than the traveled path, for example of a step recognized as defective by the device to its complete stop, or of an escalator running at about 20% over its normal velocity from the instant the over velocity begins to the complete stop of the escalator.

The present invention could be utilized to monitor other safety devices on an escalator for the shutoff of the escalator in the case of danger.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An automatic shutoff apparatus for an escalator for the initiation of the stopping of an endless step conveyor having a plurality of steps with treads supported by two lateral flat link chains and guided between two balustrade sockets, the escalator having a lead which can be stepped upon including two horizontal runs, an inclined run and two transition arches between the inclined run and the horizontal runs, comprising:

a pair of light barriers mounted on balustrade sockets on opposite sides of an endless step conveyor, one of said light barriers positioned at a connecting point between a lower transition arch and an inclined run and the other one of said light barriers positioned at a connecting point between an upper transition arch and the inclined run of the step conveyor, said light barriers positioned above said flat link chains supporting said plurality of steps and below said treads of the steps which can be stepped upon, each of said light barriers emitting and receiving a beam of light transversely to the direction of travel of the step conveyor for generating a signal to an evaluating circuit for initiating the stopping of the step conveyor; and at least one side shield on each step having at least one opening formed therein for passage of said beam of light emitted by said light barriers as said side shield passes said light barriers.

2. The apparatus according to claim 1 wherein said at least one opening in said side shield is an oblong hole having a longitudinal axis extending with respect to the tread of the step at approximately the same angle as the inclination of the inclined run of the escalator with respect to horizontal.

3. The apparatus according to claim 1 wherein a plurality of additional openings are formed in each said side shield as oblong holes each having a different angle of inclination of their longitudinal axes with respect to the tread of the step corresponding to different inclinations of the inclined run of the escalator with respect to horizontal.

4. The apparatus according to claim 3 wherein said oblong holes are formed with different lengths.

5. The apparatus according to claim 3 wherein said oblong holes are displaced in their longitudinal axes with respect to each other.

6. The apparatus according to claim 1 wherein said at least one opening is formed adjacent a trailing edge of said side shield and including a second opening for passing said light beam formed adjacent a leading edge of said side shield.

7. An improvement in an escalator having a plurality of steps supported by a pair of spaced apart link chains between a pair of balustrade sockets to form a lead and a return of an endless step conveyor, the lead including upper and lower horizontal runs connected to opposite ends of an inclined run by transition arches, the improvement comprising:

a light barrier mounted on a pair of balustrade sockets at a connection point between a transition arch and an inclined run of said escalator for emitting and receiving a beam of light transversely to the direction of travel of an endless step conveyor between the balustrade sockets for generating a signal to an evaluating circuit for initiating the stopping of the step conveyor; and at least one side shield on each step of the endless step conveyor each having an opening formed therein for the passage of said beam of light when said side shield passes said light barrier.

8. The improvement according to claim 7 wherein said opening is formed adjacent a leading edge of said side shield.

9. The improvement according to claim 8 including a second opening formed adjacent a trailing edge of said side shield for passing said light beam.

10. The improvement according to claim 8 including a plurality of additional oblong holes formed adjacent a trailing edge of said side shield for passing said light beam at different inclinations of the inclined run.

11. A method of generating a signal for use in automatically shutting off an escalator having an endless step conveyor positioned between a pair of balustrade sockets, comprising the steps of:

(a) positioning a light barrier on a pair of balustrade sockets at a connection point between a transition arch and an inclined run of an endless step conveyor, said light barrier having a light beam transmitter and receiver;

(b) forming at least one opening in a side shield for each step of the conveyor;

(c) generating a beam of light transversely to the direction of travel of the conveyor from said transmitter;

(d) sensing said beam of light with said receiver; and (e) generating a bright-dark signal pattern from said receiver to an evaluating circuit for automatically shutting off the conveyor.

12. The method according to claim 11 including a step of storing a bright-dark signal pattern representing normal operation of the conveyor, comparing said stored signal pattern with said signal pattern generated by said receiver, and stopping the conveyor when said patterns do not match.

13. The method according to claim 11 wherein step (b) includes forming one opening adjacent a leading edge of said side shield and a plurality of openings adjacent a trailing edge of said side shield, and forming each of said plurality of openings as oblong holes each having a different angle of inclination of their longitudinal axes with respect to the tread of the step corresponding to different inclinations of the conveyor.

* * * * *